United States Patent [19]

Goussinsky

[11] Patent Number: 4,561,551

[45] Date of Patent: Dec. 31, 1985

[54] PROPULSION MEANS FOR HOISTING SYSTEMS

[76] Inventor: Doron Goussinsky, 106 Shvedia St., Haifa, Israel

[21] Appl. No.: 526,324

[22] Filed: Aug. 25, 1983

[30] Foreign Application Priority Data

Jul. 15, 1983 [IL] Israel ..... 69240

[51] Int. Cl.[4] ..... B66C 17/00

[52] U.S. Cl. ..... 212/131; 212/205; 212/214; 212/218

[58] Field of Search ..... 212/189, 205–221, 212/124, 126, 131; 104/98; 105/163 R

[56] References Cited

U.S. PATENT DOCUMENTS

| | | | |
|---|---|---|---|
| 456,361 | 7/1891 | Graves | 212/214 |
| 1,745,045 | 1/1930 | Romine . | |
| 2,353,437 | 7/1944 | Bock | 212/131 |
| 2,524,189 | 10/1950 | Clay | 212/206 |
| 3,153,391 | 10/1964 | Forestall | 212/131 |
| 3,650,215 | 3/1972 | Werthessen | 212/209 |
| 3,853,209 | 12/1974 | Bond | 212/216 |
| 4,181,231 | 1/1980 | Morrissey et al. | 212/215 |
| 4,336,889 | 6/1982 | McGrew | 212/189 |

FOREIGN PATENT DOCUMENTS

| | | | |
|---|---|---|---|
| 653770 | 2/1933 | Fed. Rep. of Germany | 212/219 |
| 953006 | 10/1956 | Fed. Rep. of Germany | 212/219 |

*Primary Examiner*—Trygve M. Blix
*Assistant Examiner*—Stephen P. Avila
*Attorney, Agent, or Firm*—Ostrolenk, Faber, Gerb & Soffen

[57] ABSTRACT

The invention concerns a novel concept of "rail-less" propulsion of hoisting equipment, namely to provide two parallel rows of discrete, spaced, glidingly supporting points on which the end-beams of a crane or the like are adapted to slide, rather than by wheels on a pair of continuous rails. The gliding supports are placed on top of series of equi-distantly spaced columns and the end-beams length is at least twice the distance between adjacent supports. Various kinds of driving systems are described.

18 Claims, 30 Drawing Figures

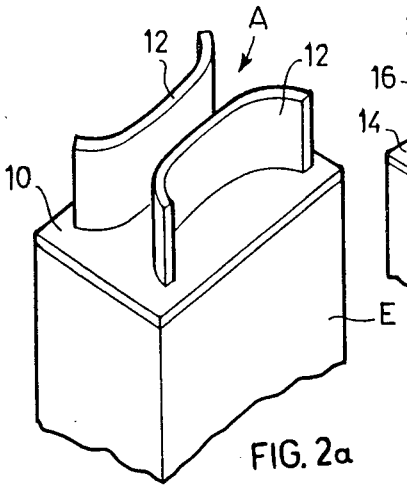
FIG. 2a
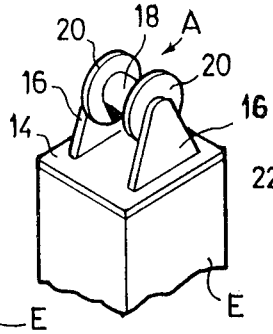
FIG. 2b
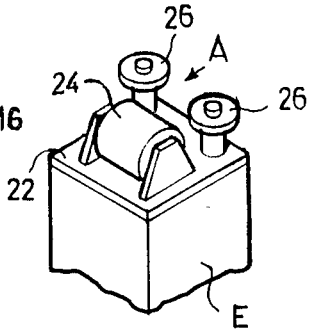
FIG 2c
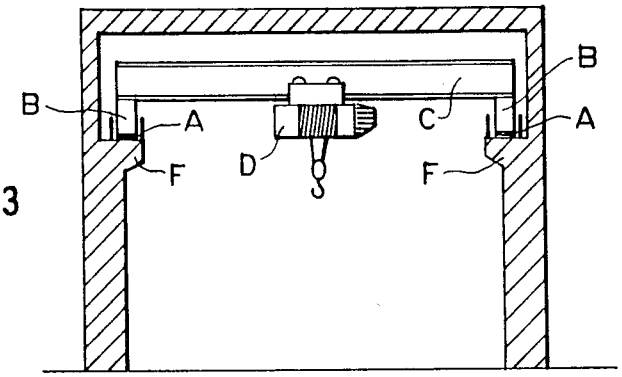
FIG. 3
FIG. 4
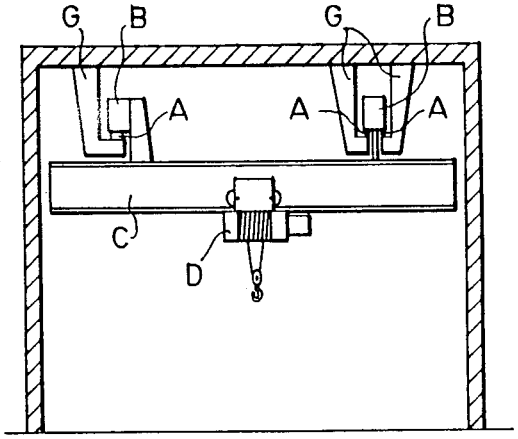
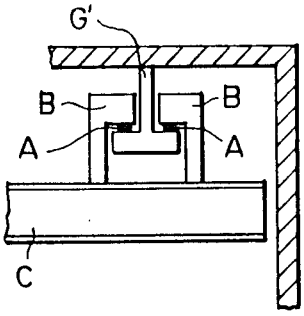
FIG. 5

PROPULSION MEANS FOR HOISTING SYSTEMS

The present invention relates to hoisting equipment, particularly to cranes of all kinds and descriptions.

As a rule, conventional bridge-cranes, gantry-cranes and similar equipment are adapted to travel along predetermined, fixed path on a railed track. This applies both to indoor and outdoor installations. Usually, the rails are mounted on beams or trusses, made of steel or concrete supported—for taking the loads—on a series of fixed points along the track (columns, roof trusses or ceiling, or foundations), while the rails' function is mainly to lead the crane along the fixed path.

However, sometimes the beams are so designed that they also serve as the rails proper, namely without a need to add special rails; conversely, the rails may be designed and used as supporting beams as well, without the addition of special beams.

In short, it can be stated that a crane is a structure (a bridge, etc.) indispensibly supported on wheels with which it travels on rails along a track.

Such railed systems suffer from numerous disadvantages, as follows:

1. Since the installation of beams and rails must be of a size suitable for bearing the load between large spans, the investment in the beams, rails and foundations, especially for long tracks may be greater than in the crane system itself.

2. The beams/rails installation may often become an obstacle, interfering with free traffic of other moveable equipment; if installed on the ground (as for gantry cranes) it may become difficult to cross the rails with another vehicle or on foot; if mounted on overhead columns—the beams "cut" the upper space of the building, thus obstructing or restricting cross-transport. Furthermore, the transport of equipment and loads in the vicinity of or below the beams is made more difficult.

3. Transferring loads from one hall to another—or from one overhead top-running bridge crane to an adjacent one—is difficult because there may not be sufficient height available between the end trucks and the main girder(s) to let the load pass thereunder. Although suspended (or "underhung") cranes may overcome this deficiency, such cranes are known to possess other disadvantages (loss of usable height, loading of the ceiling, etc.).

4. The presence of the beams and rails is generally disturbing from an architectural point of view and also because of space utilization considerations.

5. There are cases when the track extends and projects outside of the building, and therefore the gable wall of the building comprises gates adapted to be opened and closed for the passage of the crane. The continuous beams/rails structure considerably complicates the design and increases the cost of such gates. Once the beams and rails are eliminated, there would be no problem in designing simple (travelling or sliding) gates for this purpose.

6. With respect to cranes running on the floor, such as gantry or semi-gantry cranes, the track must be laid on costly, smooth and well-prepared beams or foundations.

7. When the cranes have to travel in a circle (for example in nuclear power stations), or in a curved path, the round or bent beams/rails are even more expensive and difficult to make.

It is therefore the general object of the present invention to remedy any and all of the above listed disadvantages of the conventional system and methods.

It is a further object of the invention to provide moveable cranes supporting construction wherein the beams and rails installation is eliminated.

It is a further object of the invention to substitute the beams and rails installation with end-beams integrally formed with the crane supporting structure, such end beams being adapted to travel on a series of at least two spaced anti-friction supports.

According to the invention there is provided a hoisting system adapted to travel along a predetermined track, comprising a hoist movably mounted on a bridge girder, a pair of end-beams supporting the girder at its free ends, and a driving system for displacing the hoisting system along the track characterised in that the end-beams travel on a series of discrete gliding supports spacedly arranged along the said track.

Preferably, the gliding support are equi-distantly spreaded along the track and the length of the end-beams equals at least twice the distance between adjacent supports.

According to one preferred embodiment of the invention, the driving system comprises an elongated driven member fixed to and extending along at least one of the end-beams, and a driving member associated with at least every other of said gliding supports mountings and operatively connected to said driven member.

In another embodiment, the driving system comprises a series of wheels on which said end-beams are carried, each wheel being coupled to a sprocket gear adapted to be engaged by an endless transmision chain carried by said beam between idlers and a driving geared motor.

These and other constructional features and advantages of the invention will become more clearly understood in the light of the ensuing description of a few preferred embodiments of the invention given by way of example only, with reference to the accompanying drawings, wherein FIG. 1 is a schematic representation of a hoist system incorporating the characteristic features of the invention;

FIGS. 2*a*–2*c* show alternative structures of the gliding supports;

FIGS. 3–5 show different mounting arrangements of the end-beams;

FIGS. 6*a*–6*d* illustrate the application of the invention with respect to non-linear tracks;

FIGS. 7*a*–7*d* represent a step-wise analysis of the forces and deflections prevailing in a system constructed according to the principles of the invention;

FIGS. 8*a*–8*b* show a modified arrangement of a crane mounting;

FIGS. 9*a*–9*c* show a modified construction of end-beams;

FIG. 10*a* is a three-dimensional view of an arrangement useful in the transfer of a load from one crane to another;

FIG. 10*b* is a side-view of FIG. 10*a;*

FIG. 11*a* illustrates one embodiment of a driving system;

FIG. 11*b* is a side-view of FIG. 11*a;*

FIG. 12*a* illustrates a second embodiment of a driving system;

FIG. 12*b* is a side-view of FIG. 12*a;*

FIGS. 13–14 are additional examples of driving systems for the cranes of the present invention; and FIGS. 15*a*–15*b* show electric power supply means to a crane system according to the invention.

In the following description, reference is made to steel-made, top-running, overhead bridge cranes only, it being understood, however, that this is for the sake of clarity and simplicity only, and that the invention applies equally to all kinds of track-guided cranes and related equipment.

The general principle of the invention, as schematically shown in FIG. 1, is that rather than installing a series of beams and rails along the track, there are provided two parallel lines of discrete, spaced, glidingly supporting points A only, on which two end-beams B, bridge main girder C and crab or hoist D travel. The longitudinal distances a between the support points is determined according to technical, economical, architectural and other design considerations, as the case may be. Thus, for example, for an indoor overhead bridge crane, the support points A may be situated on top of columns E which support the building (in the same way that columns support the beam for the rails of cranes in conventional systems).

With respect to gantry cranes for example, the supports A will be on the floor level, that is—without columns.

As will be further noted from FIG. 1, the end-beams B are somewhat longer than the maximal total length of two adjacent fields of the track, namely 2*a*. The end-beams are therefore always supported by at least two—but not necessarily more than three—support points A as the bridge C of the hoist D moves along the "railless" track.

FIGS. 2*a*, 2*b* and 2*c* show three out of many possible examples for designing the structure of the gliding or frictionless supporting points A. Thus, in FIG. 2*a*, the column E is provided at the top with a soft metal plate 10 forming a glidingly bearing surface for the bottom side of the end-beams B, which may be provided with freely rotatable rollers, caterpillar drives or the like (not shown) to enhance the smooth gliding movement thereof. A pair of guiding brackets 12 may be provided to prevent sidewise displacement of the beams when passing over the columns E.

The arrangement shown in FIG. 2*b* includes a plate 14 supporting a pair of brackets 16 between which a freely rotatable roller 18 is mounted. Flanged portions 20 of the roller 18 assure the proper linear travel of the end beam therebetween.

Referring to the example of FIG. 2*c*, there is provided a plate 22 carrying thereon a freely rotatable roller 24, and a pair of freely rotatable, vertically mounted guiding rollers 26.

FIGS. 3–5 illustrate various modified applications of the above described basic concept of the invention.

In FIG. 3 there are shown a series of cantilever shoulders or consoles F, bearing the support points A (instead of the upright columns E of FIG. 1). This form of construction is mostly applicable for indoors, top-running bridge cranes, as shown.

FIG. 4 shows a suspended-type bridge crane. The support points A are incorporated in single or double hanging consoles G connected to the ceiling or roof frames of the structure, as shown at the left-hand and right-hand sides of FIG. 4, respectively.

FIG. 5 is a modification of the mounting of FIG. 4, in that the hanging console G' is in the form of an inverted T-beam.

Figure 1:
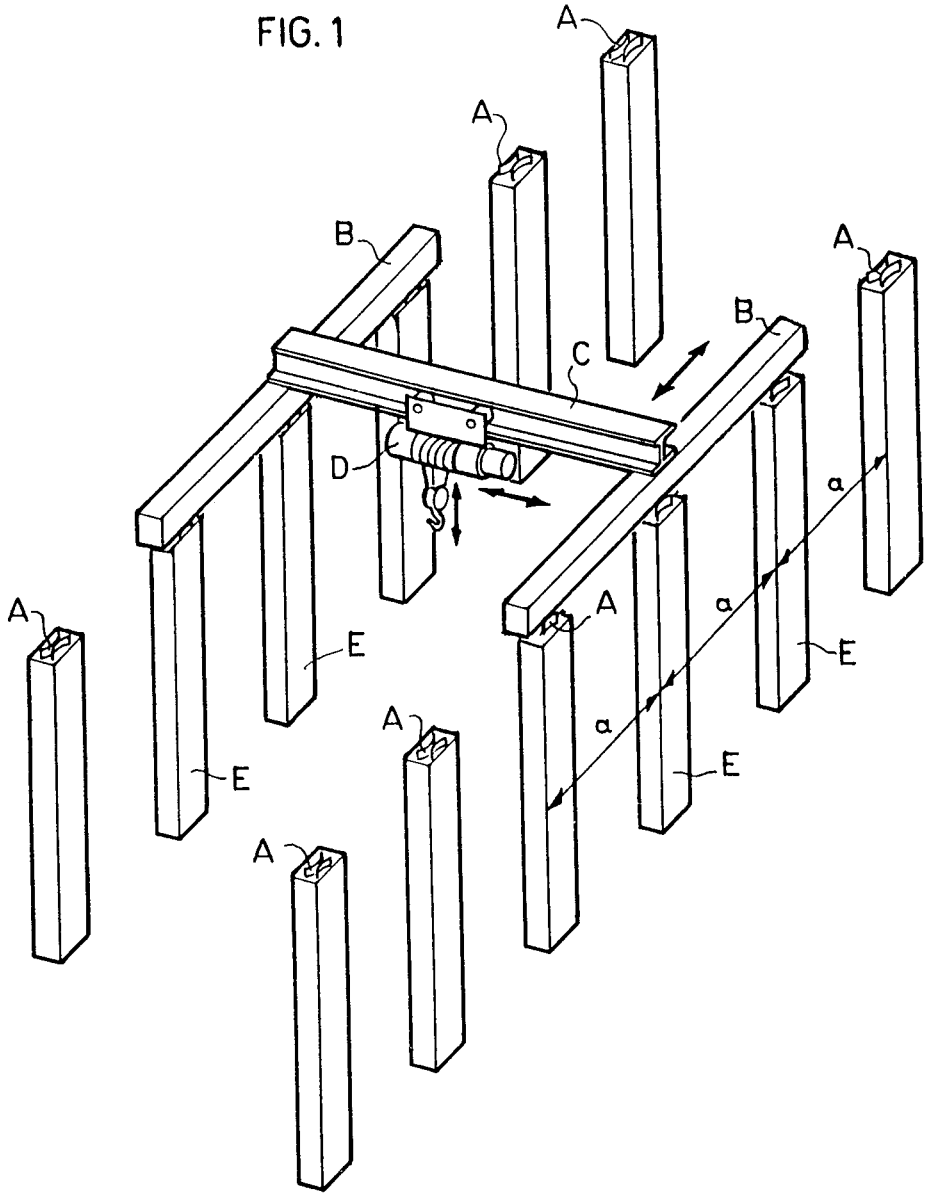
Figure 6A:
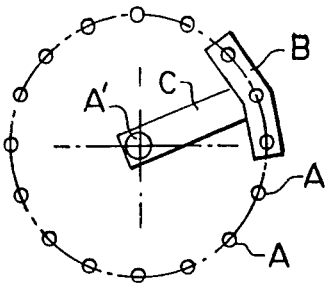

FIGS. 6*a*–6*d* relate to the application of the invention with regard to non-linear tracks, e.g. circular or curved paths. Thus, for a circular crane path (as in nuclear power stations) there will be provided a single, central support point or pivot A' as shown in FIG. 6*a*.

Figure 6B:
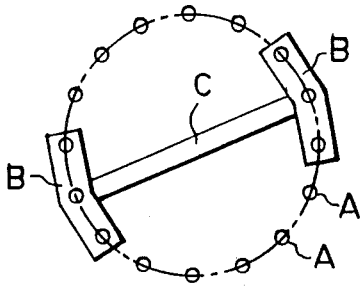

FIG. 6*b* shows a crane with two oppositely located end-beams B that travel on the support points A, namely without the central pivot A'.

Figure 6C:
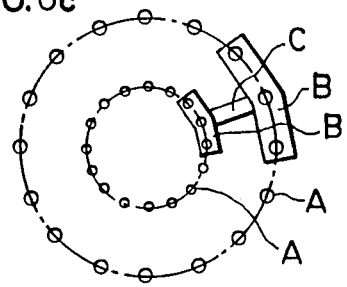

FIG. 6*c* shows a modified solution wherein two lines of support points A are provided, with two concentric arcuate end-beams B. It will be noted that in this case, if deemed necessary, either of the inner or the outer tracks may be formed as a continuous rail (like in the presently known systems), or comprised of discrete gliding points according to the concept of the present invention.

Figure 6D:
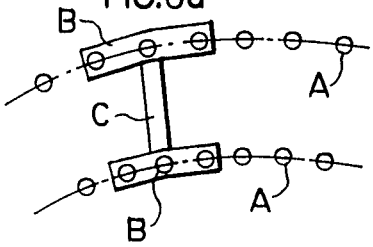

Similar design considerations may be applied to the open, curved track configuration of FIG. 6*d*.

The design of the main girder or girders C of the bridge cranes remains, in principle, unchanged relative to existing structures, be it a crane with a single girder, multiple girders or any other type; however, the main change necessarily introduced by the invention resides in the design of the end-beams B. This aspect will now be dealt with in conjunction with FIGS. 7*a*–7*d*.

The following description relates to end-beams B which are supported on at most three points A at a time; however, the support points may be closer to one another—or the beam may be longer—so that the end-beams may sometimes rest on more than three points. Moreover, the distances a between the support points along the line may vary, as long as the end-beams are longer than the maximum total length of two neighbouring fields between the support points, to ensure the safe support of the crane at all times.

Figure 7A:
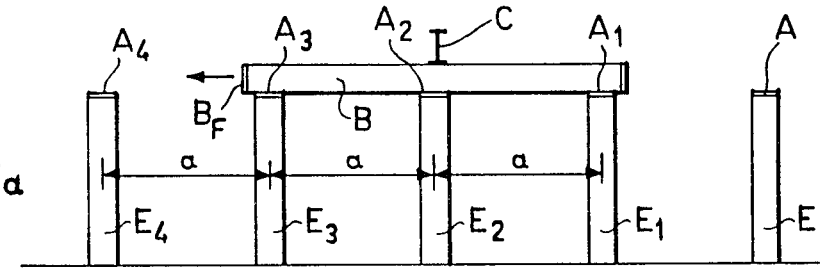

FIG. 7*a* shows the end-beams B resting on three support points A1,A2 and A3, and the main girder C is mounted thereabove.

Figure 7B:
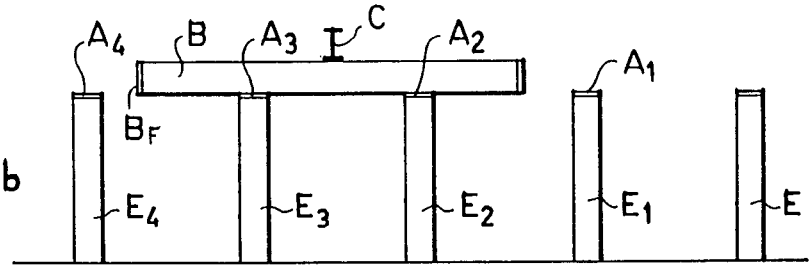

FIG. 7*b* shows the end-beam B now resting only on two support point A2, A3; therefore the end-beam must be calculated so as to take the total loads, stresses and deflections as is customary with respect to the general case of beams mounted on two supports.

Figure 7C:
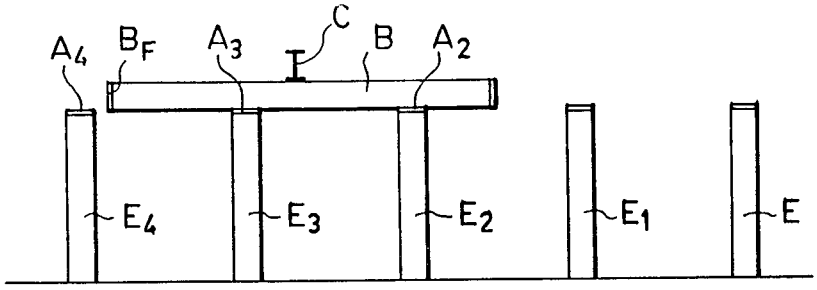
Figure 7D:
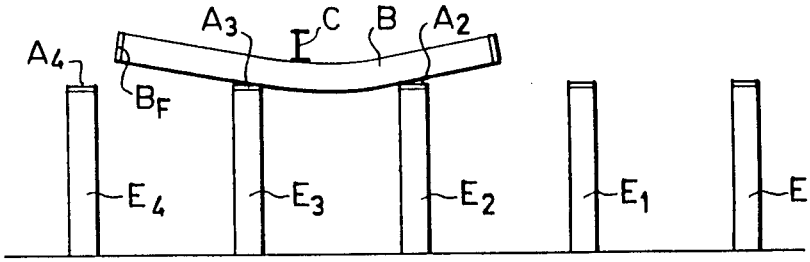

FIG. 7*c* shows the end-beam just before reaching the third support point, A4. The deflection of the beam B in all directions must be limited to such an extent that its free end BF will become smoothly rested on the support point A4, as designed. The "natural" vertical deflection of the end-beams in this position under the load of the main beam C may help by lifting the front end BF of the end-beams, as shown in FIG. 7*d* (exaggerated).

In order to further enhance the uninterrupted contact of the end portion of beam B with the support A4, auxiliary mechanisms (not shown) may be used, which will serve to change the position and/or form of the end-beam—or of the end BF of the end-beam—on passing over the support point A3 and approaching the next support point A4. It is also possible to design the support points so as to make them moveable in order to pick up the end-beam. Another possibility is to provide the end-beams (and/or the supports A) with guide means such as ribs, troughs, slides, rollers, wheels and the like that will ensure that the end-beams will come—in their turn—gradually and smoothly to rest on their respective support points.

Several measures may be taken in order to ensure maximum equilibrium and safety to avoid overturning the crane during these "cantilever" or two-points-supported transient stages of operation:

1. To make the end beam long enough, so that the extra weight thereof, when supported on the two points, will balance the weight and the dynamic forces of the cantilever;

2. To provide a system of stationary or moveable counterweights; or

3. To use guides or braces to prevent the disengagement of the beam from their supports both in the vertial and the horizontal directions.

Figure 8A:
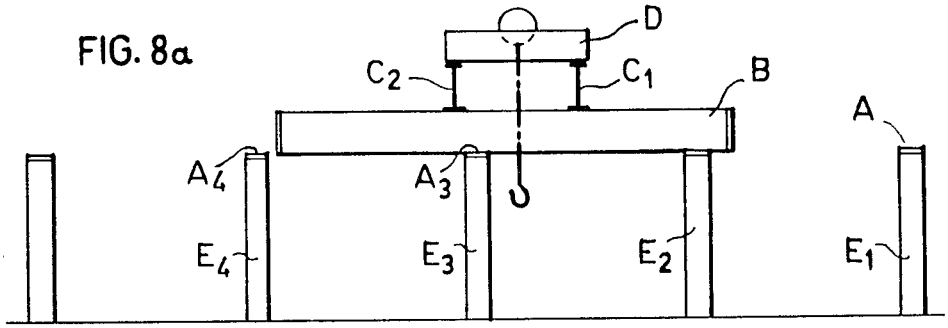
Figure 8B:
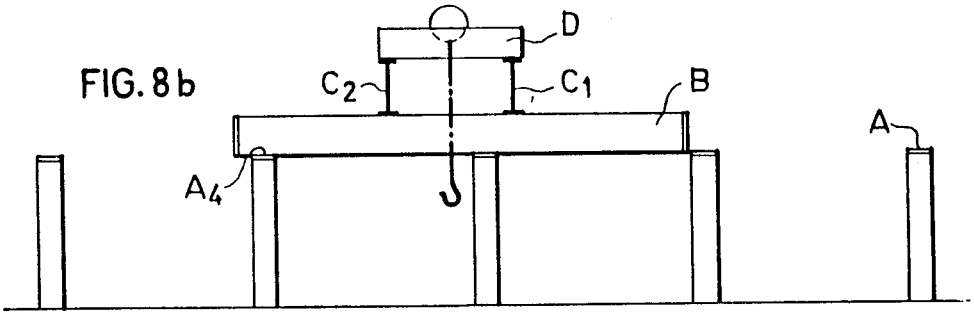

Further in this context, FIG. 8*a* shows a crane with two main girders C1, C2 located at the same position as in FIG. 7*c*. The danger of overturning is greater in this case, because part of the load now acts at a higher location above and beyond the support point A3. This danger may be effectively reduced by designing the end-beams B longer than for the single girder system of FIG. 7, in order to ensure that before the load (or the centre of gravity) passes over and beyond the support point A3, the end-beam will already become supported by the next support point A4—see FIG. 8*b*.

Figure 9A:
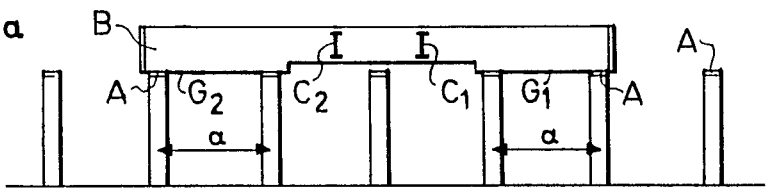
Figure 9B:
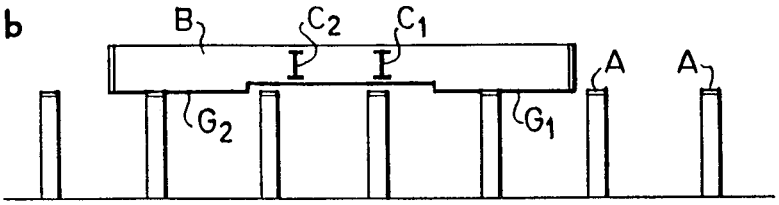
Figure 9C:
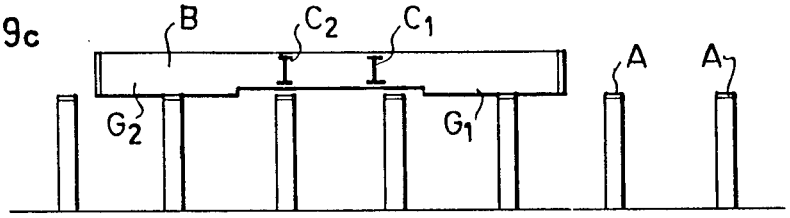

In order to spread the load on more support points, the end beam may be loner, or divided into two or more sections G1, G2 as shown in FIGS. 9*a*–9*c*. This may be convenient also for multiplegirder cranes or for wide cranes. Each "section" G of the combined end-beam B must be longer than the distance a between two neighbouring support points.

The form and structure of the end-beams B should be designed and calculated as generally known per-se with respect to beams and cantilevers for withstanding static and dynamic loads and forces, while keeping limited deflections in all directions.

Figure 10B:
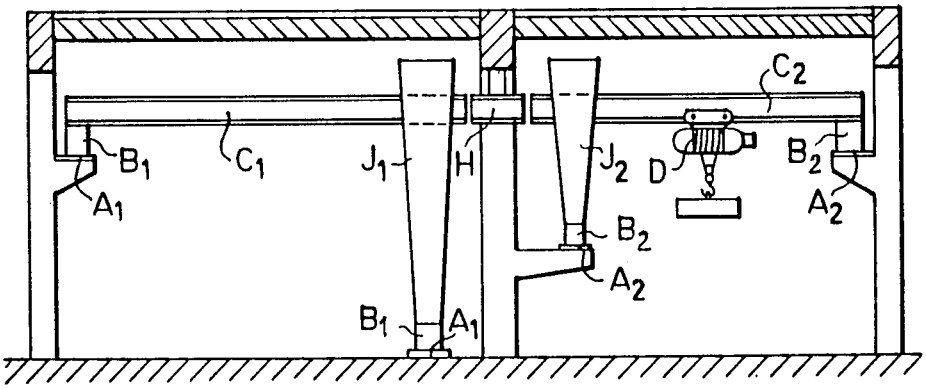
Figure 10A:
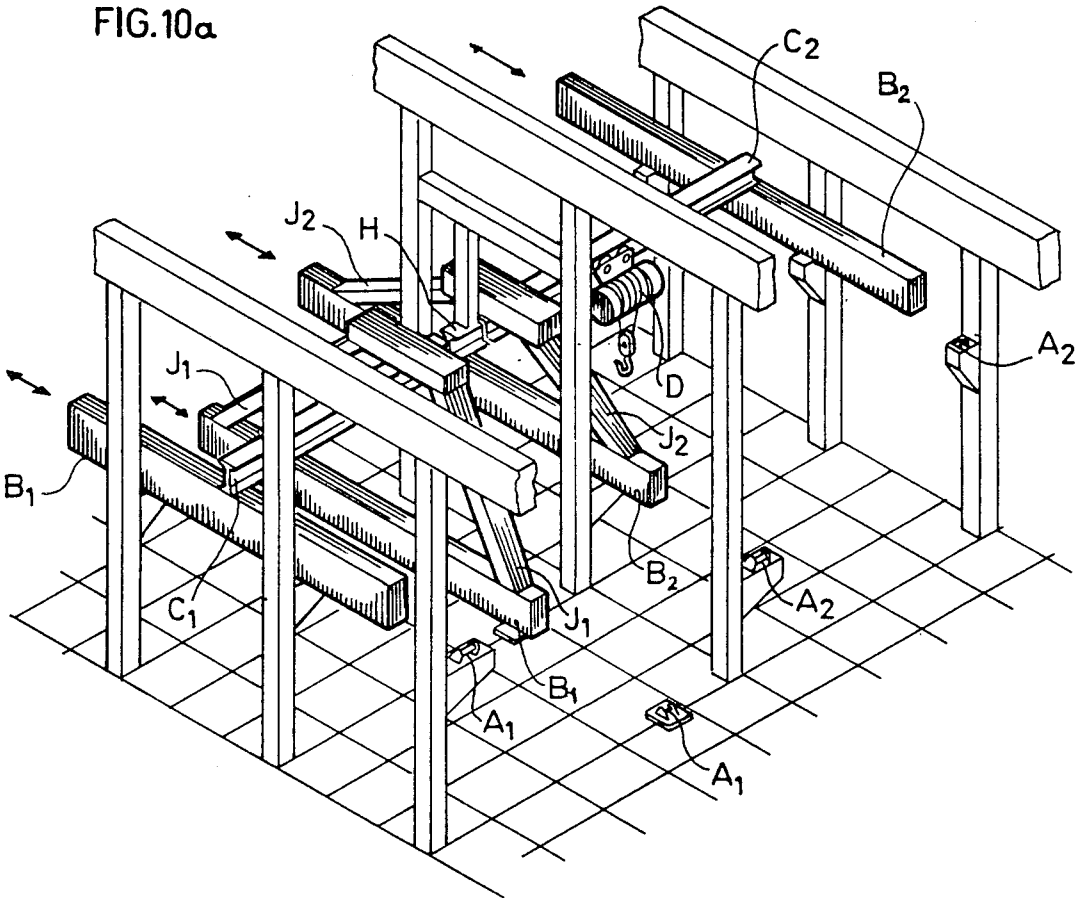

The use of the method and means of this invention for moving loads from one crane to the other or from one hall to the other will now be described with reference to FIGS. 10*a* and 10*b*. Since rails along the building are no longer needed, it is possible to design the crane as a semi-gantry crane with legs J1 (left-hand side of FIG. 10*a*) or as a special bridge crane on legs J2 (right-hand side of FIG. 10*a*). The main girders C1, C2 are extended to protrude between legs J1 and J2 (or besides the legs, according to the designer's wish). The free height between the girders C1, C2 on the one hand and the end-beams B1, B2 on the other hand is so designed that the main girders C1 and C2 are levelled and the loaded hoist D can readily pass from one to the other above the end beams, and if necessary, intermediate a bridging member H.

It will be noted that this arrangement is equally applicable with other, non-suspended, top-running cranes, and, further, that it could be used in the conventional, railed cranes as well, but then, the low-positioned beams and rails of the track might interfere and disturb traffic in the hall or between the halls (especially if they cross a door between the halls).

Several propulsion methods particularly suitable for the purposes of the present invention will now be discussed, bearing in mind the "rail-less" characteristic feature of the new system.

Figure 11A:
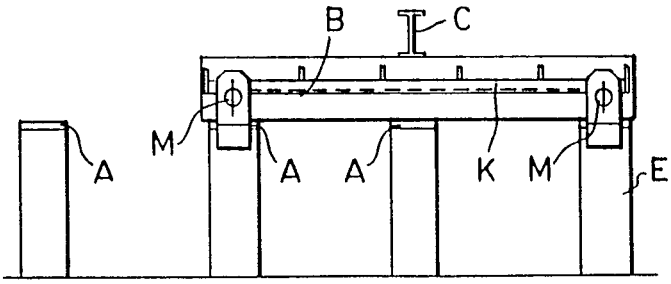
Figure 11B:
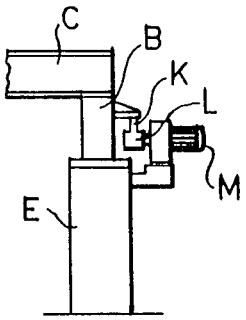

As schematically shown in FIG. 11*a* and 11*b* a toothed rack (or a straight section of a transmission chain) K is attached along at least one of the end beams B. At intervals along the line of supporting points A—say, every second support point—a pinion or sprocket wheel L (FIG. 11*b*) is provided, at a level required for the meshing thereof with the rack K. The pinions are each driven by any known means, such as a gear motor M in both directions. The end-beams glide on the support points A through any suitable anti-friction means, as above explained. The length of the rack should somewhat exceed the distance between two following pinions.

Figure 12A:
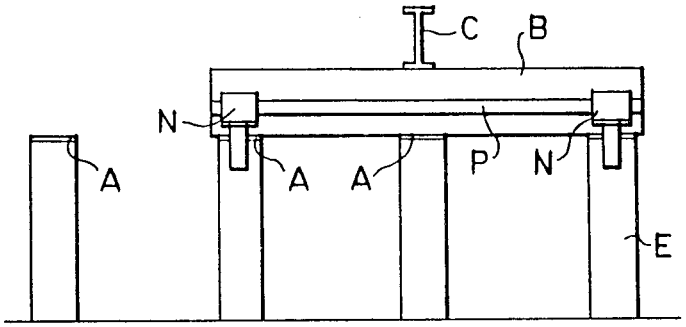
Figure 12B:
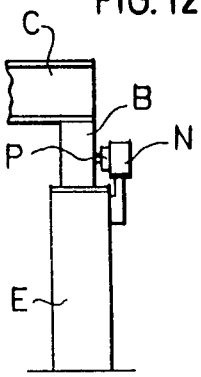

FIGS. 12*a*, 12*b* show a series of linear motors N spaced out along the track mounted on every second column E. Profiled rails P mounted along the end-beams B (or the end-beams themselves) form the driven members ("armatures") of the linear motors. Otherwise the system is similar to that described with reference to FIG. 11 above.

Figure 13:
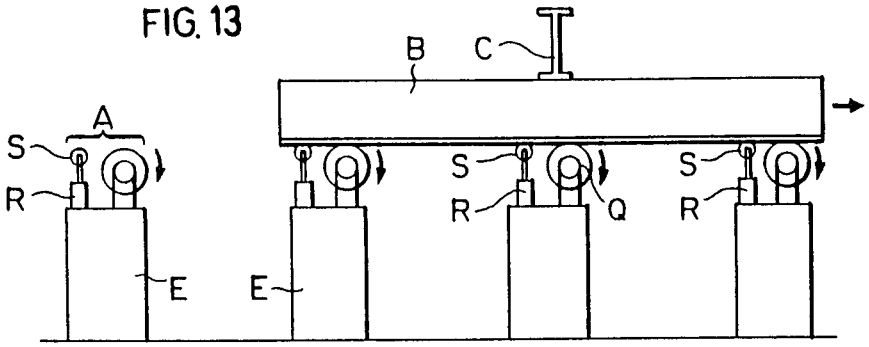

The driving system of FIG. 13 comprises a series of support wheels Q erected on top of every column E. Each—or at least every other—wheel Q is continuously driven at the same speed. The support points are further equipped with jacking devices R. These may be hydraulic pistons (as shown), nuts and screw, a system of levers, and the like. The jacking devices R are equipped with rollers S to facilitate the gliding of the beams B thereon. Once the jacking devices lift the beam B off the drive wheels Q, the movement of the crane will stop. When the crane is brought back into contact with the driving wheels, the movement will continue. Change of direction and speed are controlled by the crane operator. The drive wheels may be actuated to rotate in groups, so that not all of them will be driven all the time.

Figure 14:
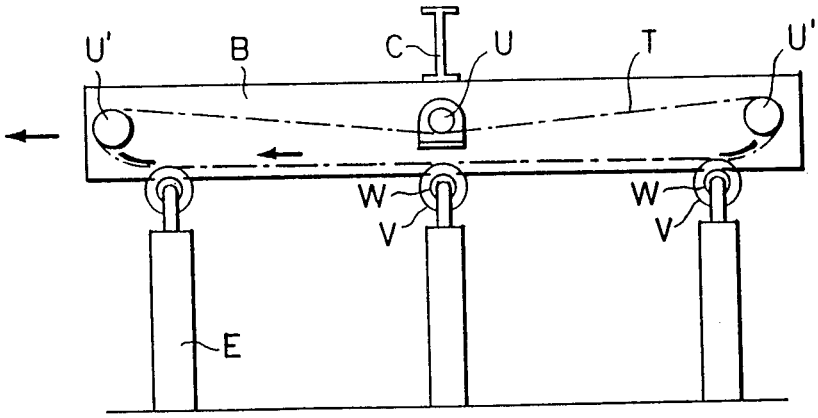

FIG. 14 shows a chain-type driving system. An endless chain T—which may be a roller chain driven by a geared motor U between idlers U'—engages at least three sprockets V at a time. The sprockets are connected to coaxial support wheels W. The end-beam B resting on the wheels W is thus driven by the rotation of the sprocket/wheel assembly.

This arrangement is similar to the one used in connection with conventional overhead chain conveyors, but modified to satisfy the specific conditions of the present invention.

Figure 15A:
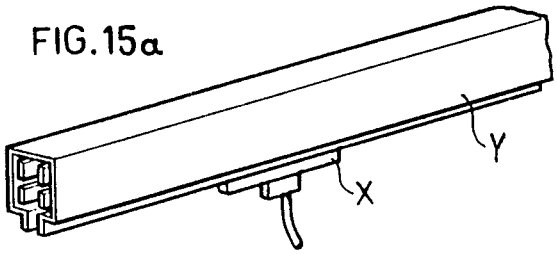
Figure 15B:
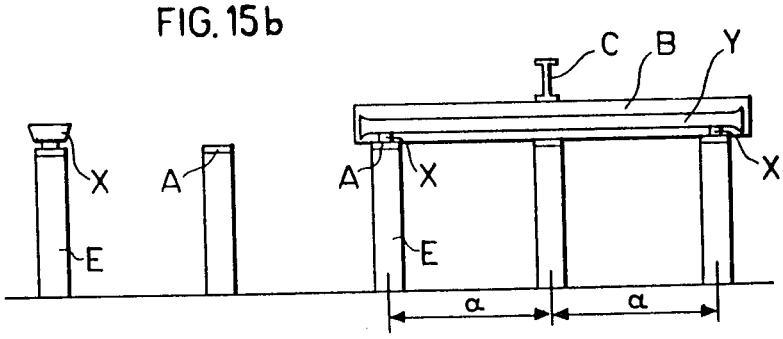

Finally, reference is made to FIGS. 15*a* and 15*b* showing preferred arrangements of electric power supply to the novel "rail-less" system.

Electric power supply by busbars is known in the art, and consists of a fixed busbar Y (closed or open) extending along the track. A trolley X with current collectors (not shown) travels along the busbar by the crane to which it is attached.

Due to the features of the crane system according to the present invention, the long power-track can be dispensed with and substituted with a plurality of current-collectors X spread along the track, say at each (or every other) support point A (FIG. 15*b*); Consequently the length of busbar Y becomes only a little longer than the distance between the two current collectors (i.e. the distance a or 2*a* as the case may be) and it is attached to the crane (preferably along the end beam B, as shown). The ends of the busbar track are fitted with slides or other devices to ensure that the current collectors will safely contact the busbar during their sliding movement therealong. It should be mentioned in this context that while trolleys with current collectors travelling onto sections of stationary busbars are known in monorails and other systems, the reverse use applied to cranes as described above is new and advantageous: It eliminates the use of a full line as a rail between the support points of the crane, and is compatible with the other characteristics of the "rail-less" system as heretofore described.

It might be mentioned that the "enclosed busbar" method is known for pneumatic drive systems which is also applicable for the purposes of the present invention.

Having thus described the invention with particular reference to the preferred form thereof, it will be obvious to those skilled in the art to which the invention pertains, after understanding the invention, that various changes and modifications may be made therein without departing from the spirit and scope of the invention, as defined by the claims appended hereto.

What is claimed is:

1. A hoisting system adapted to travel along a predetermined track, comprising:

a bridge girder having two free ends;

a hoist movably mounted on the bridge girder;

a pair of end-beams, each supporting the girder at a respective one of its free ends, each end-beam extending in a direction generally perpendicular to the bridge girder; and a driving system for displacing the hoisting system along the track by causing each of the end-beam to travel generally in the perpendicular direction on a respective series of discrete gliding supports spacedly arranged along and generally parallel to the said track.

2. The system as claimed in claim 1 wherein the gliding supports are equi-distantly spaced along the track.

3. The system as claimed in claim 2 wherein the length of the end-beams equals at least twice the distance between adjacent supports.

4. The system as claimed in claim 3 wherein the gliding supports comprise a flat gliding surface slidingly engaging a bottom surface of said end-beams.

5. The system as claimed in claim 3 wherein the gliding supports comprise roller means rotatably engaging a bottom surface of said end-beams.

6. The system as claimed in claim 1 wherein the gliding supports are mounted on top of a series of columns.

7. The system as claimed in claim 6 wherein the gliding surfaces are mounted on consoles projecting from a structure.

8. The system as claimed in claim 1 wherein said track is non-linear.

9. The system as claimed in claim 8 wherein said track is circular.

10. The system as claimed in claim 1 further comprising a second bridge girder having two free ends each supported on a respective one of the end-beams, the second bridge girder being spaced from the first-mentioned bridge girder, the hoist being mounted on both the first and second bridge girders.

11. The system as claimed in claim 1 comprising two or more bridge girders like and including the first mentioned bridge member, each mounted on a respective pair of end-beams, the girders being levelled with respect to each other so that the hoist is adapted to cross from one of the free ends of one girder to one of the free ends of the other when the girders are brought into alignment with each other.

12. The system as claimed in claim 1 wherein the driving system comprises an elongated drive member fixed to and extending along at least one of the end-beams, and a driving member associated with at least every other of said respective gliding supports and operatively connected to said driven member.

13. The system as claimed in claim 12 wherein said driven member is a toothed rack and said driving member is a motor driven pinion meshed with the rack.

14. The system as claimed in claim 12 wherein said driven member is the armature of a linear motor and said driving member is a linear motor.

15. The system as claimed in claim 1 wherein the driving system comprises a series of continuously driven wheels on which said end-beams are carried, means being provided to selectively disengage the beams from any of the wheels at any given location along the track.

16. The system as claimed in claim 15 wherein said disengaging means comprise jacking devices associated with said wheels for lifting the beams.

17. The system as claimed in claim 1 wherein said driving system comprises a series of wheels on which at least one of said end-beams is carried, said driving means further comprising at least one idler and a driving geared motor supported on said end-beam and an endless transmission chain extending between the geared motor and the idler, each wheel being coupled to a sprocket gear adapted to be engaged by said endless transmission chain.

18. The system as claimed in claim 1 further comprising means for supplying electric power to the driving system comprising an elongated busbar attached to the end-beam and being in sliding contact with a series of current collectors associated with said supports.

* * * * *